United States Patent [19]

Schreiber et al.

[11] 4,381,603

[45] May 3, 1983

[54] DRY SHAVER

[75] Inventors: Friedrich Schreiber, Frankfurt; Horst Kirchner, Eschborn, both of Fed. Rep. of Germany

[73] Assignee: Braun Aktiengesellschaft, Kronberg, Fed. Rep. of Germany

[21] Appl. No.: 132,593

[22] Filed: Mar. 21, 1980

[30] Foreign Application Priority Data

Mar. 31, 1979 [DE] Fed. Rep. of Germany ..... 2913017

[51] Int. Cl.[3] ..... B26B 19/04

[52] U.S. Cl. ..... 30/43.92; 30/346.51

[58] Field of Search ..... 30/43.5, 43.6, 43.8, 30/43.9, 43.91, 43.92, 346.51

[56] References Cited

U.S. PATENT DOCUMENTS

| | | | |
|---|---|---|---|
| 2,240,633 | 5/1941 | Testi | 30/346.51 X |
| 2,242,180 | 5/1941 | Jepson | 30/346.51 X |
| 2,304,909 | 12/1942 | Hanley | 30/346.51 X |
| 2,719,356 | 10/1955 | Ritter | 30/43.92 |
| 3,440,724 | 4/1969 | Wich | 30/34.1 |
| 4,134,202 | 1/1979 | Buchholz | 30/43.92 |

FOREIGN PATENT DOCUMENTS

| | | | |
|---|---|---|---|
| 1801100 | 10/1959 | Fed. Rep. of Germany . | |
| 2058823 | 5/1971 | France . | |
| 524471 | 8/1940 | United Kingdom | 30/346.51 |
| 669172 | 3/1952 | United Kingdom | 30/346.51 |
| 824257 | 11/1959 | United Kingdom | 30/346.51 |

*Primary Examiner*—Gary L. Smith

*Attorney, Agent, or Firm*—Raymond J. De Vellis

[57] ABSTRACT

A dry shaver has a shearing foil clamped to a holder detachably mounted on a shaver housing over a cutter. The holder is arranged to enable the shearing foil to be moved between an operating position wherein the shearing foil is wrapped around the cutter in a wrap angle exceeding 180° and a second position wherein the wrap angle is less than 180° to facilitate removal of the holder and shearing foil from the shaver housing.

4 Claims, 3 Drawing Figures

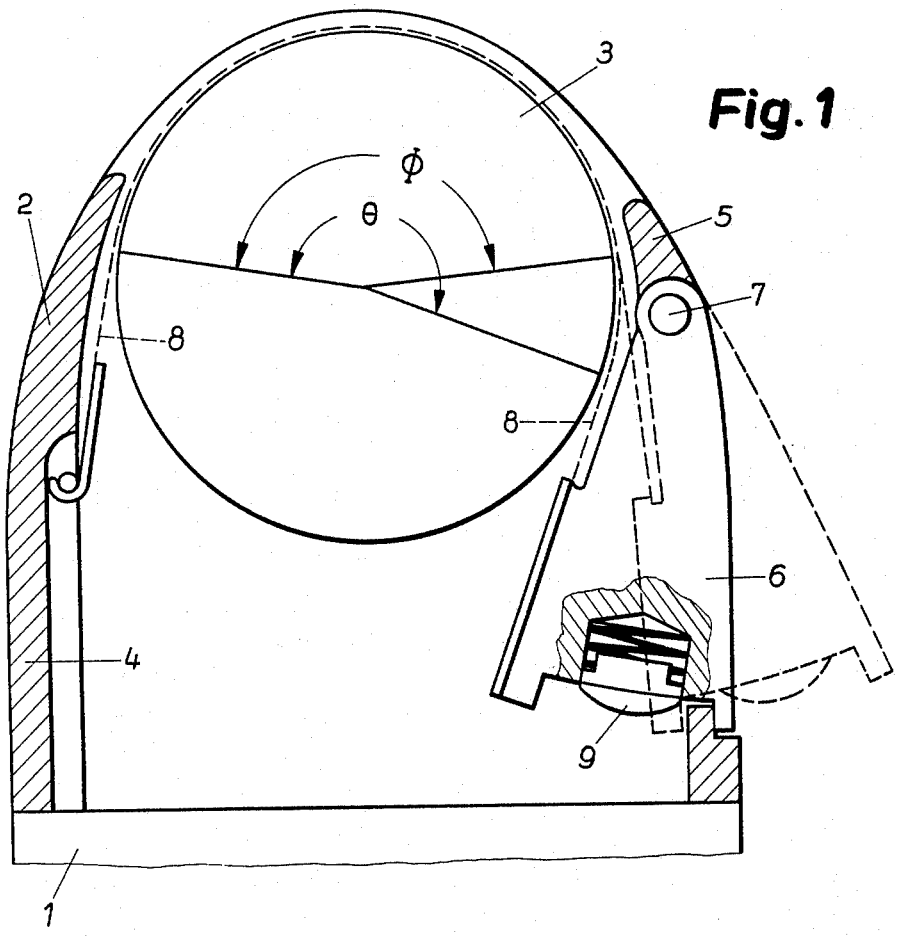
Fig. 1
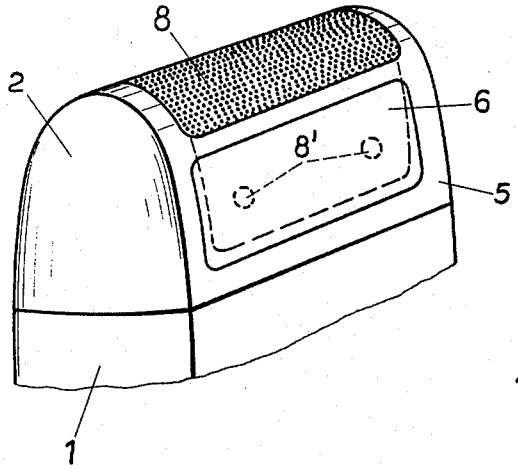
Fig. 2
Fig. 3
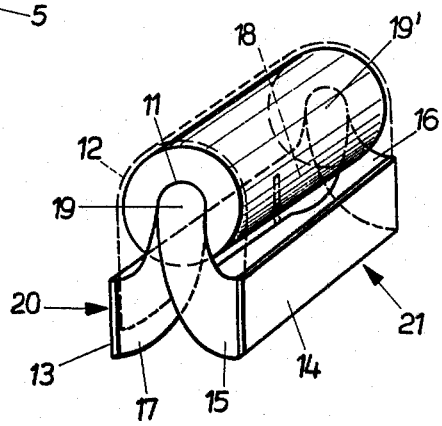

DRY SHAVER

BACKGROUND OF THE INVENTION

1. Field of the Invention

This invention relates to dry shavers and more particularly to dry shavers having a shearing foil clamped to a holder adapted to move the shearing foil between different wrap angles.

2. Description of the Prior Art

A dry shaver with a working combination of movable cutter and a shearing foil clamped in a curved fashion to longitudinally extending side walls of a holder detachably mounted on a shaver housing is disclosed in U.S. Pat. No. 3,440,724.

To be able to remove the prior art shearing foil holder from the cutter, the shearing foil could not undercut or be wrapped anywhere beneath the cutter, as the cutter would otherwise interfere with the removal of the shearing foil holder. The admissible wrap angle of the shearing foil can for this reason not be greater than 180°. In practice, a wrap angle of about 120° is chosen so that during removal, the shearing foil is at once free from the cutter and is not damaged by the latter.

This relatively small wrap angle has the drawback that the active cutting area of the dry shaver is comparatively small. This results in a lower cutting efficiency. The prior art shearing foil holder dimensions are relatively large close to the housing of the dry shaver to provide clearance so that the holder can be immediately set free from the cutter when removed from the housing, whereby the dry shaver must be considerably thicker than the diameter of the cutter. Thus it has a clumsy shape which is not only unattractive looking, but also disadvantageously affects its handling properties.

Older dry shavers are known in which the shearing foil, without additional reinforcement or a removable holder, is simply clamped over the cutter (German Pat. No. 802,052). With these designs greater wrap angles can be used, as the shearing foil is not lifted off but is wound off the cutter. Aside from other basic defects of such designs, it has also proven disadvantageous that the shearing foil, which because of its small thickness of 0.05 mm approximately is very delicate is frequently damaged by too tight clamping on the cutter or by other improper handling. Aside from that, the removal and reclamping of the shearing foil required considerable effort and skill, so that the work necessary to clean the dry shaver was often considered a nuisance.

Another known alternative of achieving a large wrap angle involves shaping the shearing foil as a tube or tube section which is longitudinally slid over a cylindrical cutter. In practice, these designs have also not prevailed because the highly vulnerable shearing foil can be damaged during the slide-on process by the edges of the individual cutting blades of the cutter. This applies especially to the front edge of the shearing foil which lies unprotected during the slide-on process.

An object of the present invention is to develop a dry shaver of the type mentioned at the outset in which on the one hand the shearing foil may undercut the cutter and be wrapped around at an angle of more than 180°, while on the other hand it is still possible to remove the shearing foil, without the danger of damage, quickly and simply from the cutter to expose the latter for inspection and cleaning. This task is solved by the invention in that at least one of the side walls is designed so that it can at least partially be swung out around a pivot axis running longitudinally to the blade head.

With the invention, this solution is possible both with dry shavers having a cutter moving back and forth, as well as with dry shavers of other designs having a cutter-foil system, e.g., a dry shaver with a cutter roller rotating around a horizontal axis or a cutter arrangement moving pendulum-like. An advantage of the present invention applies to dry shavers in which the shearing foil undercuts the cutter or is wrapped around it at more than 180°, since the shearing foil can easily and quickly be removed and reattached to the cutter without the danger of damage. Since removal and reattachment of the shearing foil is usually carried out after every use of the dry shaver to clean the cutter with a brush, the handling of the dry shaver is greatly facilitated by this simplification and improvement.

A further advantage is that the shearing foil holder in its operating position can be narrower than the diameter of the cutter. This causes the shaver body to be slimmer than the customary dry shavers. An additional advantage of the invention must be pointed out, namely that the shearing foil holder with the shearing foil can be cleaned better than a traditional shearing foil holder.

It is not absolutely necessary to construct the side walls of the shearing foil holder in such a fashion that they can be swung out completely. It is sufficient if the respective side wall can be swung out partially, namely always in accordance with the measurements of the shearing foil, with that portion of the side wall which carries the holding means for the shearing foil.

An advantageous embodiment of the invention includes a side wall that can be locked in an operating position by means of a catch device, in which the shearing foil is wrapped around the blade head in a large wrap angle. This form of construction is especially expeditious from the structural viewpoint and particularly simple in handling. Compared with the traditional dry shavers with shearing head frame or foil holder, only one additional work step is required to remove or reattach the shearing foil holder with the shearing foil, namely the swinging-out or swingin-in of the one side wall or at least one part of it.

An especially large wrap angle of the shearing foil can be achieved if another advantageous construction of the invention is followed, namely the shearing foil holder is formed by two holder parts which can be rotated in pincer-fashion around a common axis.

Additional advantages of the invention will be apparent from the following description of two of the many construction possibilities of the invention.

SUMMARY OF THE INVENTION

In a dry shaver having a movable cutter with a longitudinal axis cooperatively coupled to a shearing foil clamped in a curved fashion to longitudinally extending side walls of a holder which can be removed from a shaver housing, the improvement comprises at least one of the side walls being adapted to at least partially swing out around a swivel axis extending in a direction substantially parallel to the longitudinal axis of the cutter.

BRIEF DESCRIPTION OF THE DRAWING

FIG. 1 is a cross sectional view of a shearing head of a dry shaver omitting all parts not essential for the understanding of the invention, FIG. 2 is a perspective view of the shearing head; and FIG. 3 is a simplified perspective view of a variation of the shearing foil holder with cutter.

DESCRIPTION OF THE PREFERRED EMBODIMENTS

FIG. 1 shows a housing 1 of a dry shaver with the frame-like shearing foil holder 2 attached. The shearing foil holder 2 has longitudinally extending side walls 4 and 5 running substantially parallel to a longitudinal axis of a cutter 3. The cutter 3 may be a reciprocally movable cutter block or a rotatable cutter in the form of a roller. The cutter 3 may be connected in a detachable or fixed fashion with a drive lever of a motor, not shown, in the housing. The cutter 3 in the form of a roller may be located in the shearing foil holder 2 in a fixed or detachable fashion, so that the cutter 3 when the shearing foil holder 2 is removed is either also removed from its bearings, or remains on the drive element.

One part 6 of the side wall 5 can be swung outward around a pivot axis 7 which runs in a direction substantially parallel to the longitudinal axis of the cutter 3, so that it may assume the position shown in the drawing in broken line. A shearing foil 8 is attached to a side wall 4 on the one hand, and to the swing-out part 6 of side wall 5 on the other. As shown in FIG. 2, this part 6 is at least as wide as the shearing foil 8 and grasps around holding devices 8' for the cutting foil 8. Part 6 of the side wall 5 is locked in the swung-out and swung-in positions by means of a spring biased catch 9.

As shown in FIG. 1, the shearing foil 8 lies against the cutter 3 with a large wrap-around angle, $\theta$, exceeding 180°.

The device described works as follows. To remove the shearing foil holder 2 with the shearing foil 8, part 6 of the side wall 5 is first swung outward so that part 6 comes into the position indicated by the broken line. To do this, the latch force of the catch 9 must be overcome. When part 6 of the side wall 5 is in its swung-out position, the shearing foil 8 is partially wound from the cutter 3 so that the wrap angle, $\Phi$, has become smaller or less than 180°. In this manner, the shearing foil holder 2 with the shearing foil 8 can easily be lifted upward from the housing 1 of the dry shaver without the danger of damaging the shearing foil 8 or the cutter 3.

FIG. 3 shows a cutter 11 in the form of a roller over which a shearing foil 12, shown in broken line, is clamped. The ends of the shearing foil 12 are fastened on two areas 13 and 14 which by means of two arms each, 15,16 or 17,18 are linked to an axis 19, 19'. In this manner, area 14 with the arms 15,16 and area 13 with the arms 17,18 form two holder parts 20 and 21 which pincer-fashion can be rotated around the common axis 19,19'.

To attach the shearing foil 12 to the dry shaver, the shearing foil holder with the shearing foil 12, consisting of the two holder parts 20,21 is first put over the cutter 11, with areas 13,14 swung outward. Thereafter the areas 13,14 are rotated toward each other so that the shearing foil 12 moves with an increasing wrap angle, to lie against the cutter 11. Catch devices in the dry shaver housing hold the areas 13 and 14 in the final position after having been swung toward each other.

What is claimed is:

1. A dry shaver comprising:

a shaver housing including a shearing foil holder;

a movable cutter having a longitudinal axis; and a shearing foil which cooperates with said movable cutter, said shearing foil being clamped in a curved fashion on longitudinally extending side walls of said shearing foil holder, at least one of said side walls of said shearing foil holder being adapted to at least partially rotate about a swivel axis, the swivel axis extending in a direction substantially parallel to the longitudinal axis of said cutter, wherein said shearing foil, in an operating position, forms a wrap angle greater than 180° with respect to said cutter and, in a removed position, forms a wrap angle less than 180° with respect to said cutter.

2. The dry shaver as in claim 1 wherein said side wall capable of rotating about the swivel axis includes a catch device for locking said side wall capable of rotating about the swivel axis in the operating position in which said shearing foil forms a wrap angle greater than 180° with respect to said cutter.

3. The dry shaver as in claim 1 wherein said shearing foil holder comprises first and second side walls and said first and second side walls, in pincer fashion, are pivotable about a common axis.

4. The dry shaver as in claim 3 wherein said first and second side walls each include a member connected to the common axis.

* * * * *